US005475336A

United States Patent [19]

Singh et al.

[11] Patent Number: 5,475,336

[45] Date of Patent: Dec. 12, 1995

[54] PROGRAMMABLE CURRENT SOURCE CORRECTION CIRCUIT

[75] Inventors: Raminder J. Singh; Ansuya P. Bhatt; Khen S. Tan, all of Singapore, Singapore

[73] Assignee: Institute of Microelectronics, National University of Singapore, Singapore, Singapore

[21] Appl. No.: 358,780

[22] Filed: Dec. 19, 1994

[51] Int. Cl.[6] ..... G05F 3/02

[52] U.S. Cl. ..... 327/543; 327/538; 327/541; 327/546

[58] Field of Search ..... 327/538, 540, 327/541, 543, 545, 546; 323/312, 315

[56] References Cited

U.S. PATENT DOCUMENTS

| | | | |
|---|---|---|---|
| 4,954,769 | 9/1990 | Kalthoff | 327/540 |
| 4,996,453 | 2/1991 | Zanders et al. | 327/546 |
| 4,999,516 | 3/1991 | Suter et al. | 327/540 |
| 5,061,862 | 10/1991 | Tamagawa | 327/541 |
| 5,235,222 | 8/1993 | Kondoh et al. | 327/541 |
| 5,254,883 | 10/1993 | Horowitz et al. | 327/541 |
| 5,339,272 | 8/1994 | Tedrow et al. | 327/540 |

*Primary Examiner*—Terry Cunningham
*Attorney, Agent, or Firm*—Lawrence Y. D. Ho

[57] ABSTRACT

A small and easy to fabricate programmable current source correction circuit. The correction circuit consists of a first current division circuit for establishing a reference current; a programmable correction current circuit for establishing the amount of correction current required; a second current division circuit for further reducing the reference current into smaller step or resolution; and a source-sink controlling circuit for determining whether the present invention is to operate as a current sink or current source. The present invention consists of substantially less number of circuit modules and can be fully integrated into a single chip which requires substantially smaller chip area and can operates at a substantially higher frequency compared to prior art.

10 Claims, 4 Drawing Sheets

PROGRAMMABLE CURRENT SOURCE CORRECTION CIRCUIT

BACKGROUND OF THE INVENTION

1. Field of the Invention

The present invention relates to current source correction circuits for correcting current mismatch in metal-oxide-semiconductor transistors due to process variation.

2. Art Background

In today's information age, there are great demands for fast high-resolution analog-to-digital (A/D) and digital-to-anolog (D/A) converters. These converters are used in digital audio systems, telecommunication, and precision data acquisition systems, just to name a few. Many of these converters are designed using current sources. However, due to process variation, there is mismatch between transistor current sources, and hence resulting in low conversion accuracy. Therefore, there is a need to correct this current mismatch in the transistor current sources.

Prior art disclosed by Groeneveld, Schouwenaars, Termeer and Bastiaansen, entitled "A Self-Calibration Technique for Monolithic High-Resolution D/A Converters," in IEEE Journal of Solid-State Circuits, Vol. 24, No. 6, December 1989, pages 1517–1522; and Manoli, entitled "A Self-Calibration Method for Fast High-Resolution A/D and D/A Converters," in IEEE Journal of Solid-State Circuits, Vol. 24, No. 3, June 1989, pages 603–608 described two apparatus for calibrating current source.

Groeneveld et. al. described an apparatus using a switching network to switch between two nodes: a reference current node and an output current terminal node. When the switch is at the reference current node, a reference current flows into a n-channel transistor and a charge is stored by the intrinsic gate-source capacitance. When the switch is at the output current terminal node, that same amount of charge is available at this node which is used for calibration. There are imperfections, as stated by the authors, due to changes in the gate voltage of the transistor during switching. Furthermore, there is a time limit the switch must be switched back to the reference current node to recharge so as to keep its output current within a specified range. This limits the frequency at which the circuit can be operated. In fact, the apparatus can only operate between a narrow range between 20 Hz and 20 kHz.

Manoli described an apparatus making use of a modified dual-slope method which altogether eliminates the need for calibration voltages. Although the approach presented is different from that of Groeneveld, nevertheless, the apparatus consists of a substantially large number of circuit modules and it occupies large chip area. Therefore, it is not feasible for mass production due to high cost. Furthermore, the apparatus is restricted to operate at frequency lower than 70 kHz

SUMMARY OF THE INVENTION

The objects of the present invention is to provide a small, easy to fabricate and substantially high operating frequency programmable current source correction circuit. The correction circuit consists of a first current division circuit for establishing a reference current; a programmable correction current circuit for establishing the amount of correction current required; a second current division circuit for further reducing the reference current into smaller step or resolution; and a source-sink controlling circuit for determining whether the present invention is to operate as a current sink or current source.

The present invention consists of substantially less number of circuit modules and can be fully integrated into a single chip which requires substantially smaller chip area and can be operated at a very high frequency upto 50 MHz.

DETAILED DESCRIPTION OF THE INVENTION

Figure 1A:
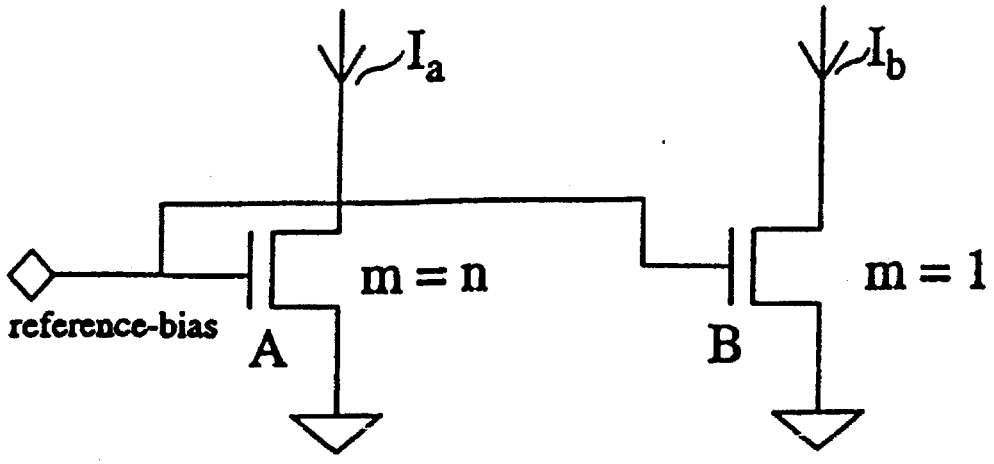
FIG. 1*a* shows two typical NMOS transistor current sources operating in the saturation region and have the same gate voltage.

FIGS. 1*a* shows two typical current sources A and B. Current source B consists of one transistor (m=1) and current source A has n transistors (m=n) all of which are the same size as B, all connected in parallel. Therefore, for perfect transistor matching, it is expected that $I_a=n*I_b$, where $I_a$ is current flowing through current source A and $I_b$ is current flowing through current source B. However, due to process variation in fabricating these transistors, they may not have the same current flowing through them. So, in reality, it is more likely that $I_a=n*I_b\pm\Delta n*I_b$, where $\Delta n*I_b$ is the amount of transistor current mismatch. To make $I_a=n*I_b$, a programmable current source C is coupled to current source A as shown in FIG. 1*b*.

Figure 1B:
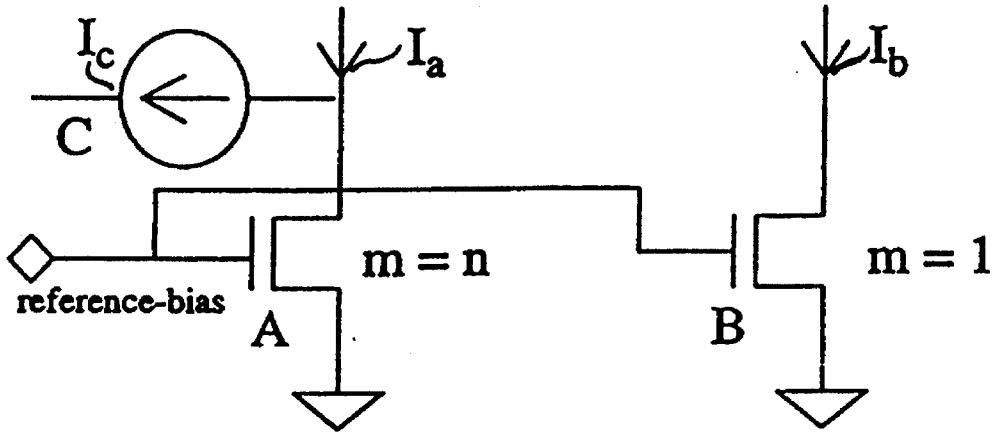
FIG. 1*b* shows the current sources of FIG. 1*a* with the addition of the present invention connected to a current source to be corrected.

Referring to FIG. 1*b*, it shows the current sources of FIG. 1*a* with the addition of the present invention, a programmable current source C, connected to a main current source to be corrected. Therefore, for instance, for a 12 bit D/A converter, the present invention can be coupled to the few most significant bits (MSB) of the converter, since these bits are the main contributor of convesion error. From the calculation above, it follows that $I_a$ now equals $n*I_b\pm\Delta n*I_b+I_c$, where $I_c$ is current flowing through current source C. Therefore, for $I_a$ to equal $n*I_b$ (i.e. no transistor current mismatch), $I_c\pm\Delta n*I_b$ must equals zero. Clearly, there is a need for a correction circuit to reduce $I_c\pm\Delta n*I_b$ to zero. Hence, current source C must be able to operate either as a current sink or a current source in order to cancel out $\Delta n*I_b$. That is, if transistor current mismatch is $\Delta n*I_b$, then, $I_c$ must equals $-\Delta n*I_b$, and similarly, if transistor current mismatch is $-\Delta n*I_b$, then, $I_c$ must equals $\Delta n*I_b$. This correction circuit is shown in FIG. 2.

PREFERRED EMBODIMENT OF THE PRESENT INVENTION

Figure 2:
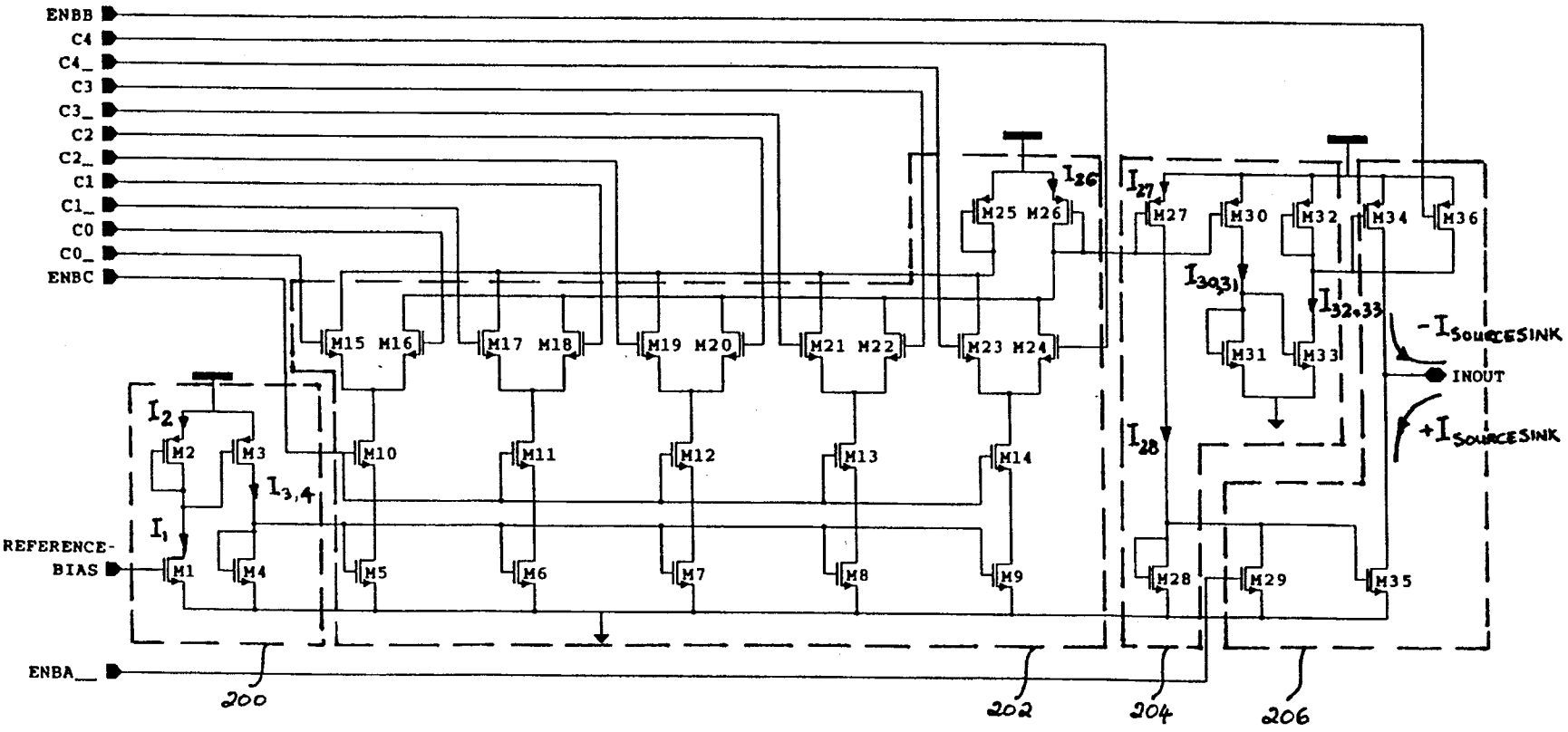
FIG. 2 shows a circuit implementation of the present invention.

FIG. 2 shows a current source correction circuit, of the present invention, capable of reducing $I_c\pm\Delta n*I_b$ to zero. The correction circuit consists of binary weighted current sources and current mirrors. The current flowing through these current sources is a function of a reference-bias voltage. This voltage is selected according to the required output level and is the same as the one applied to the main current source. Any changes in the reference-bias voltage will result in the same effect on correction current and main current source. The correction circuit can act as either a current source or a current sink. The mode of operation is controlled by two programmable inputs, namely ENBA_ and ENBB. "Sink" and "source" simply refer to the direction of current flow: If a circuit supplies 'positive' current to a point, it is a source, and vice-versa. The amount of correction current (i.e. $I_c$) required is controlled by five programmable inputs, namely C0 to C4.

Referring again to FIG. 2, the current source correction circuit consists of four sub-circuits: a first current division circuit 200 for establishing a reference current from which the rest of the circuit current is compared to; a programmable correction current circuit 202 for establishing the amount of correction current required; a second current division circuit 204 for further reducing the reference current into small step or resolution; and a source-sink controlling circuit 206 for determining whether the present invention is to operate as a current sink or current source.

The first current division circuit 200 consists of 2 n-channel transistors, M1 and M4, and 2 p-channel transistors, M2 and M3. Transistor M1 has the same channel length and width, and gate voltage (reference-bias voltage) as that of main current source. Both transitor M1 and main current source are operating in saturation region, hence, the magnitude of current $I_1$ through transistor M1 is the same as the magnitude of current through the main current source. Transistor M1 is selected as a reference transistor in term of channel length and width, and hence the current, to which other transistors in the circuit are compared to. The size (i.e. channel length and width) of transistors M2, M3 and M4 are selected such that, $I_{3,4}$, current through transistors M3 and M4, equals to $I_2/2=I_1/2$.

The programmable correction current circuit 202 consists of 3 series of n-channel transistors, M5 to M9, M10 to M14 and M15 to M24, and 2 p-channel transistors, M25 and M26. The first series of n-channel transistors M5 to M9 are 5-bit binary weighted current sources. The size of transistor M9 is selected to be the same as that of transistor M4 and, therefore, has the same amount of current flowing through it. That is, $2^0*I_1/2$ ($=I_1/2$). Transistor M8 has more weightage and its size is selected such that the current flowing through it is $2^1*I_1/2$. Similarly, the sizes of transistors M7, M6, and M5 are selected such that the current flowing through them are $2^2I_1/2$, $2^3*I_1/2$, and $2^4*I_1/2$ respectively.

The second series of n-channel transistors M10 to M14 are main switches. When no correction is required, these transistors are turned off by setting input ENBC to zero in order to save power. This series of transistors can be removed completely without effecting the rest of the circuit if this option is not required.

The third series of n-channel transistors M15 to M24 are current switching transistors and are controlled by inputs C0 to C4 and their complement C0_to G4_. For example, when C4=0 (C4_=1), transistor M24 is turned off; and transistor M23 is turned on. These two transistors are connected in such a manner to prevent any possible current leakage flowing through transistor M24 duo to potential difference between device junction. Similarly, for transistors M21 and M22, M19 and M20, M16 and M18, and M15 and M16. Current flowing through transistor M26, $I_{26}$, depends on which of tho switches M16, M18, M20, M22, and M24 are on. Therefore, $I_{26}=C_f*I_{3,4}$, where $C_f=C0*2^4+C1*2^3+C2*2^1+C4*2^0$. Since $I_{3,4}=I_1/2$, then, the total current flowing through transistor M26 becomes: $I_{26}=C_f*I_12$.

The second current division circuit 204 consists of 3 p-channel transistors, M27, M30 and M32, and 3 n-channel transistors, M28, M31 and M33. The size of transistor M27 is selected such that $I_{27}=I_{26}4$. Hence, $I_{27}=C_f*I_1/8$. Current flowing through transistor M28, $I_{28}$, is equivalent to $I_{27}$. Similarly, currents flowing through transistors M30 and M31, $I_{30,31}$, and transistors M32 and M33, $I_{32,33}$, are equivalent and are both equal to $I_{27}$. That is, $I_{30,31}=I_{32,33}=C_f*I_1/8$. This division of current carried out here determines the resolution or incremental step at which error can be corrected. For example, if there is a 0.1% process variation, then, for a 10 bit converter, there exists one least significant bit (LSB) error. For a 12 bit converter, there exists 4 LSB error. So for the configuration of the correction circuit as shown in FIG. 2, it is capable of correcting error from ⅛ LSB up to 3⅛ LSB. If larger range and higher resolution is required, then, binary weighted current sources can be extended and transistors M27, M28, M30, M31, and M32's channel lenghts and widths can be altered to achieve the required resolution.

The source-sink controlling circuit 206 consists of 2 p-channel transistors, M34 and M36, and 2 n-channel transistors, M29 and M35. Transistors M29 and M36 are controlled by 2 inputs, ENBA_ and ENBB, respectively. Combination of these inputs determine the mode of operation of the correction circuit. When both inputs ENBA_ and ENBB are 0, then, correction circuit operates in a current sink mode. This is achieved by turning transistor M35 on and transistor M34 off. On circuit implementation level, device size of transistors M33 and M36 is selected such that for ENBB=0, gate voltage of M34 is greater then $V_{DD}-V_{tp}$ (p-channel MOS threshold voltage) thereby turning transistor M34 off. Therefore, current flowing through transistor M35, coming from node INOUT, is $I_{SourceSink}=I_{27}=I_{28}=C_fI_1/8$, since it acts as current mirror of transistor M28. When inputs ENBA_ and ENBB are 1, then, correction circuit operates in a current source mode. This is achieved by turning transistor M35 off and transistor M34 on. On circuit implementation level, device size of transistors M27 and M29 is selected such that for ENBA_=1, gate voltage of transistor M35 is less than Vtn (n-channel MOS threshold voltage) thereby turning transistor M35 off. So, current flowing through transistor M34, going out to node INOUT, is $I_{SourceSink}=-I_{32,33}=-C_f*I_18$, since it acts as current mirror of transistor M32. Transistors M34 and M35 cannot be turned on at the same time, therefore, the condition ENBA_ =0 and ENBB=1 is not allowed.

Since $I_1=I_b$ (as shown in FIG. 1*b*), and $I_{SourceSink}$ ($=I_c$, as shown in FIG. 1*b*)$=\pm C_f*I_b/8$, for $I_c\pm\Delta n*I_b$ to equal 0, $\Delta n$ must equals $C_f/8$. Therefore, by selecting appropriate inputs C0 to C4, ENBA_, ENBB, and ENBC will result in $I_c\pm\Delta n*I_b=0$. That is, $I_a=n*I_b$ as required. The values (either 1—high signal or 0—low signal) of these inputs can be programmed and stored in a memory device. For example, a correction codeword 11100001 stands for ENBA_=1, ENBB=1, ENBC=1, C0 to C3=0, and C4=1 can be stored in the memory device. This codeword directs the correction circuit to operate in a current source mode drawing in current equivalent to $2^0*I_1/8$where $I_1$ depends on the reference-bias voltage. The selection of C0 to C4 depends on the amour of current mismatch to be corrected. This correction codeword is unique to a particular converter since each converter would yield different variation.

Figure 3A:
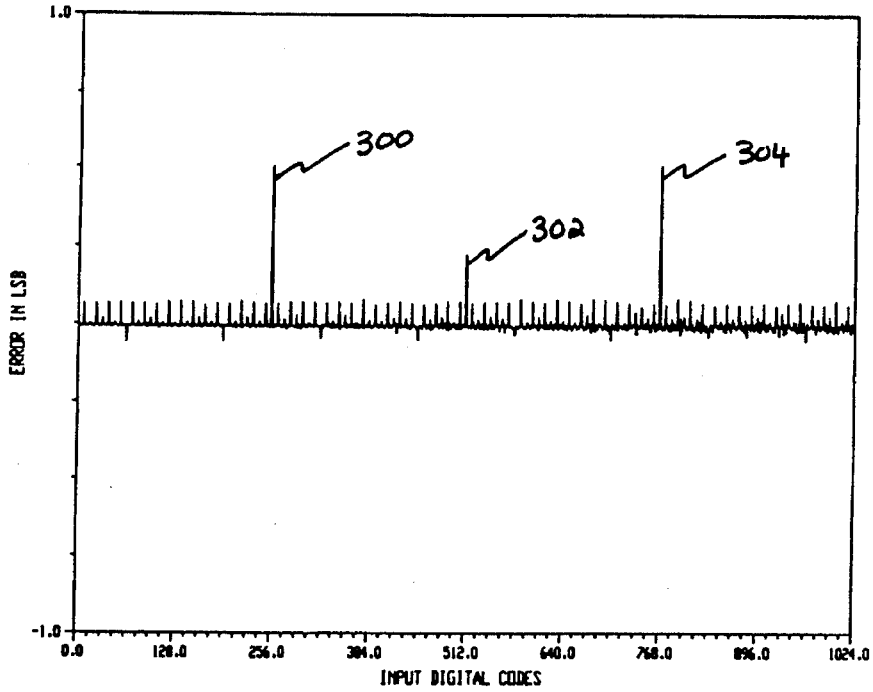
FIG. 3*a* shows a differential non-linearity (DNL) curve of a converter without the present invention coupled to it.
Figure 3B:
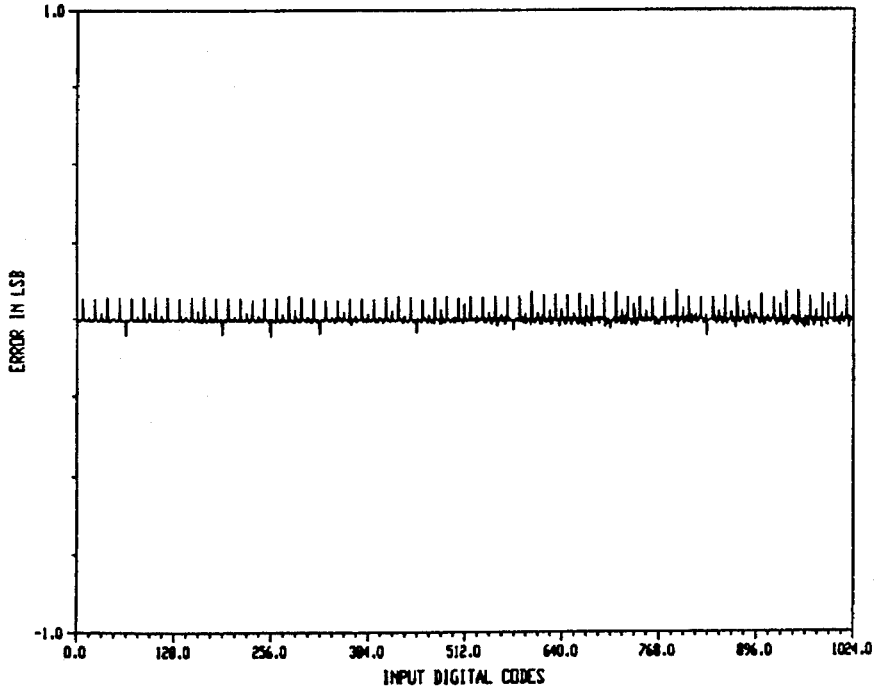
FIG. 3*b* shows a DNL curve of the converter with the present invention coupled to it.
Figure 4A:
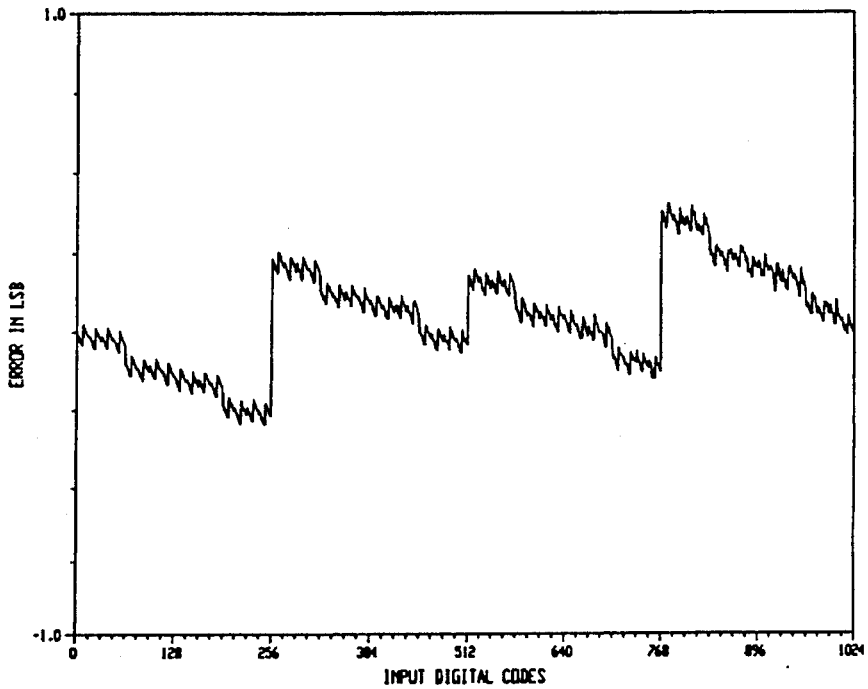
FIG. 4*a* shows an integral non-linearity (INL) curve of the converter without the present invention coupled to it.
Figure 4B:
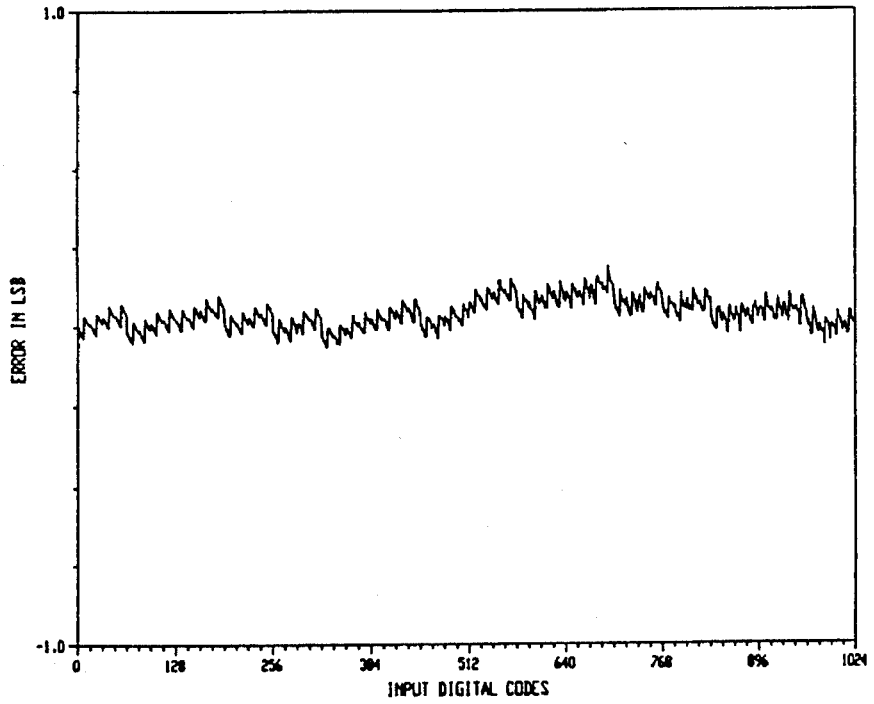
FIG. 4*b* shows an INL curve of the converter with the present invention coupled to it.

The above-described correction circuit is implemented to correct the first three most significant bits (MSB) of a 10 bit Digital to Analog converter. All three corrected bits use identical correction circuit. Typical differential non-linearity (DNL) curves before and after correction are shown in FIGS. 3*a* and 3*b* respectively. DNL curve in FIG. 3*a* shows the difference or error deviation from the ideal curve at each particular point or resolution. Clearly, the more noticeable errors are at points 300, 302 and 304. These errors are removed by the correction circuit as shown in FIG. 3*b*. Typical integral non-linearity (INL) curves before and after correction are shown in FIGS. 4*a* and 4*b* respectively. FIG. 4*a* shows large INL. After correction, the large INL has been reduced significantly as shown in FIG. 4*b*. Clearly, the present invention has linearized the curves dramatically and hence resulting in high accurate conversion.

All the circuit modules described above can be integrated into one chip and it does not require large chip area. Furthermore, the present invention can be operated at a substantially higher speed (upto 50 MHz) comparted to prior art.

The correction circuit as shown in FIG. 2 can be modified to handle error correction other than between ⅛ LSB and 3⅛ LSB by relatively selecting the sizes of transistors according to the resolution and amount of correction current required. Therefore, it is anticipated that many changes may be made by one of ordinary skill in the art without departing from the spirit and scope of the invention.

We claim:

1. A programmable current source correction circuit for correcting transistor current mismatch due to process variation, comprising:

(A) a data storage means for storing correction information;

(B) a first current division circuit for establishing a reference current, said first current division circuit further comprises:

a first n-channel transistor and a first p-channel transistor, said first n-channel transistor having a gate coupled to a reference-bias voltage, a source coupled to a common ground, and a drain coupled to a drain of said first p-channel transistor, said first p-channel transistor having a gate coupled to its drain, and a source coupled to a high potential, said reference-bias voltage being the same as that being applied to the current sources being corrected;

a second n-channel transistor and a second p-channel transistor, said second n-channel transistor having a source coupled to the common ground, a gate coupled to its drain, and the drain coupled to a drain of said second p-channel transistor, said second p-channel transistor having a gate coupled to the drain of said first n-channel transistor, and a source coupled to the high potential;

(C) a programmable correction current circuit for establishing the amount of correction current required, said programmable correction current circuit further comprises:

a third p-channel transistor, a first, second and third plurality of n-channel transistors, said third p-channel transistor having a source coupled to the high potential, a gate coupled to its drain, and the drain coupled to said first plurality of n-channel transistors' drains, said first plurality of n-channel transistors being switches and having their sources coupled to respective ones of said second plurality of n-channel transistors' drains, and having their gates coupled to a plurality of inputs for receiving information from said data storage means, said information indicating which of said first plurality of n-channel transistors are to be turned on, said second plurality of n-channel transistors being also switches and having their gates coupled to a first input, and their sources coupled to respective ones of plurality said third plurality of n-channel transistors' drains, said first input turning said second plurality of n-channel transistors on when high and off when low, said third plurality of n-channel transistors being binary weighted current sources and having their gates coupled to the drain of the second n-channel transistor, and their sources coupled to the common ground;

(D) a second current division circuit for further reducing said reference current into smaller resolution, said second current division circuit further comprises:

a fourth p-channel transistor and a third n-channel transistor, said fourth p-channel transistor having a source coupled to the high potential, a gate coupled to the drain of said third p-channel transistor, and a drain coupled to a drain of said third n-channel transistor, said third n-channel transistor having a gate coupled to its drain, and a source coupled to the common ground;

a fifth and sixth p-channel transistors and a fourth and fifth n-channel transistors, said fifth p-channel transistor having a source coupled to the high potential, a gate coupled to the drain of said third p-channel transistor, and a drain coupled to a drain of said fourth n-channel transistor, said fourth n-channel transistor having a gate coupled to its drain, and a source coupled to the common ground, said sixth p-channel transistor having a source coupled to the high potential, a gate coupled to its drain, and the drain coupled to a drain of said fifth n-channel transistor, said fifth n-channel transistor having a gate coupled to the drain of said fifth p-channel transistor, and a source coupled to the common ground; and (E) a source-sink controlling circuit for controlling the mode of operation, said source-sink controlling circuit further comprises:

a seventh and eighth p-channel transistors and a sixth and seventh n-channel transistors, said seventh p-channel having a source coupled to the high potential, a gate coupled to the drain of said sixth p-channel transistor, and a drain coupled to an input-output node, said input-output node being coupled to the current source being corrected, said eighth p-channel transistor having a source coupled to the high potential, a drain coupled to the drain of said sixth p-channel transistor, and a gate coupled to a second input, said second input turning said eighth p-channel transistor on when low and off when high, said sixth n-channel transistor having a drain coupled to the drain of said third n-channel transistor, a source coupled to the common ground, and a gate coupled to a third input, said third input turning said sixth n-channel transistor on when high and off when low, a said seventh n-channel transistor having a gate coupled to the drain of said third n-channel transistor, a source coupled to the common ground, and a drain coupled to the input-output node, said mode of operation being a sink when both said second and third inputs being low and being a source when both said second and third inputs being high.

2. The programmable current source correction circuit of claim 1, wherein the reference current is obtained by selecting channel lengths and widths of the first and second p-channel transistors and second n-channel transistor such that current flowing through the second n-channel transistor is a fraction of the current flowing through the first n-channel transistor.

3. The programmable current source correction circuit of claim 1, wherein the amount of correction current required flows through the third p-channel transistors, said amount of correction current required being determined by the number of switches of the first series of n-channel transistors being turned on, said first series of n-channel transistors being turned on when said series of inputs being high.

4. The programmable current source correction circuit of claim 1, wherein the second series of n-channel transistors are turned off when no current correction is required.

5. The programmable current source correction circuit of claim 1, wherein the third series of n-channel transistors having a first transistor with channel length and width equals to that of the second n-channel transistor, and the subsequent transistors having their channel lengths and widths such that they are increasing in a binary weighted manner from said first transistor.

6. The programmable current source correction circuit of claim 1, wherein the reference current is further reduced by selecting the channel lengths and widths of the fourth, fifth, and sixth p-channel transistors and third, fourth, and fifth n-channel transistors such that current flowing through them is a fraction of the current flowing through the third p-channel transistor.

7. The programmable current source correction circuit of claim 1, wherein the lengths and widths of the fourth p-channel transistor and sixth n-channel transistor are selected such that for a high signal third input, the seventh n-channel transistor is turned off due to a drop in voltage below n-channel MOS threshold voltage at its gate.

8. The programmable current source correction circuit of claim 1, wherein the lengths and widths of the fifth n-channel transistor and eighth p-channel transistor are selected such that for a low signal second input, the seventh p-channel transistor is turned off due to a drop in gate to source voltage below p-channel MOS threshold voltage.

9. The programmable current source correction circuit of claim 1, wherein the seventh p-channel transistor is a current mirror of the sixth p-channel transistor.

10. The programmable current source correction circuit of claim 1, wherein the seventh n-channel transistor is a current mirror of the third n-channel transistor.

* * * * *